US006198344B1

(12) United States Patent
Sung

(10) Patent No.: US 6,198,344 B1
(45) Date of Patent: Mar. 6, 2001

(54) BACK BIAS VOLTAGE LEVEL SENSING CIRCUIT

(75) Inventor: Ha-Min Sung, Cheongju (KR)

(73) Assignee: Hyundai Electronics Industries Co., Ltd., Ichon-shi (KR)

( * ) Notice: Subject to any disclaimer, the term of this patent is extended or adjusted under 35 U.S.C. 154(b) by 0 days.

(21) Appl. No.: 09/469,309

(22) Filed: Dec. 22, 1999

(30) Foreign Application Priority Data

Sep. 7, 1999 (KR) ..... 99-37832

(51) Int. Cl.[7] ..... G05F 1/10

(52) U.S. Cl. ..... 327/545; 327/78; 327/143; 327/546

(58) Field of Search ..... 327/77, 78, 142, 327/143, 198, 538, 540, 541, 543, 545, 546

(56) References Cited

U.S. PATENT DOCUMENTS 4,749,880 * 6/1988 Kobatake ..... 327/78
5,877,652 * 3/1999 Oh ..... 327/546
6,114,899 * 9/2000 Jang et al. ..... 327/540

* cited by examiner

*Primary Examiner*—Kenneth B. Wells
*Assistant Examiner*—Paul Dinh
(74) *Attorney, Agent, or Firm*—Fleshner & Kim, LLP

(57) ABSTRACT

A back bias voltage level sensing circuit includes a constant current generation unit for generating a constant current regardless of a variation in a power supply voltage; a switch for transferring or disconnecting the constant current generated from the constant current generation unit under the control of a switch control signal; a current distribution unit for distributing the constant current transferred by the switch by using a current mirror under the control of a first control signal; a switching current removal unit for flowing the switching current generated when the switch is turned on and turned off to the ground according to a second control signal; a back bias voltage level sensing unit for sensing a level of a back bias voltage and outputting an output signal according to the current distributed by the current distribution unit; and a switching controlling unit for receiving an oscillating signal and the output signal from the back bias voltage level sensing unit and outputting a switch control signal for turning on and turning off the switch in a predetermined period, a first control signal for controlling the current distribution unit, and a second control signal for controlling the switching current removal unit. With this construction, a switching current doesn't affect the back bias voltage level sensing unit, which advantageously prevents a delay in the operation of the semiconductor memory device and a malfunction of the back bias voltage pumping circuit, having an effectiveness of reduction in current consumption.

5 Claims, 4 Drawing Sheets

STANDBY, SELF-REFRESH MODE
ACTIVE MODE

OSC

DETSW

CON2

CON1

VBB
VREF

NS
VTH

DETA

BACK BIAS VOLTAGE LEVEL SENSING CIRCUIT

BACKGROUND OF THE INVENTION

1. Field of the Invention

The present invention relates to a back bias voltage level sensing circuit, and more particularly, to a back bias voltage level sensing circuit which is capable of preventing a malfunction caused due to a switching current, by turning on a back bias voltage level sensing unit after the switching current, that occurs when a circuit is driven or stopped, is flown to a ground.

2. Description of the Background Art

FIG. 1 is a circuit diagram of a back bias voltage level sensing circuit in accordance with a conventional art, in which a back bias voltage level sensing unit is turned on once in every predetermined period to sense a back bias voltage level.

As shown in this drawing, the back bias voltage level sensing circuit includes a constant current generation unit 1 for generating a constant current ICON regardless of a variation of a power supply voltage VCC; a switch 2 for transferring or disconnecting the constant current ICON generated from the constant current generation unit 1 under the control of a switch control signal DETSW; a current distribution unit 3 for distributing the constant current ICON transferred by the switch 2 by using a current mirror; a back bias voltage level sensor 4 for sensing a level of a back bias voltage VBB by means of the current distributed by the current distribution unit 3 and outputting a sensing signal DETA; and a switching controlling unit 5 for receiving an oscillating signal OSC and the sensing signal DETA from the back bias voltage level sensing unit 4 and outputting a switch control signal DETSW for turning on and turning off a switch in a predetermined period.

The constant current generation unit 1 includes a first PMOS transistor PM1 being connected in series between a power supply voltage VCC and a ground voltage VSS, having a gate connected to the ground voltage VSS; a first NMOS transistor NM1 having a gate and a drain which are commonly connected; a second PMOS transistor PM2 connected in series between the power supply voltage VCC and the ground voltage VSS, having a gate and a drain which are commonly connected; a second NMOS transistor having a gate connected to the gate of the first NMOS transistor NM1; and a third PMOS transistor PM3 having a source to which the power supply voltage is applied, a gate connected to the gate of the second PMOS transistor PM2, and a drain to which the constant current flows.

The switch 2 includes a fourth PMOS transistor PM4 having a gate to which a switch control signal DETSW inverted by a first inverter INV1 is applied, a source to which the constant current ICON from the constant current generation unit 1 is applied, and a drain connected to a first node N1.

The current distribution unit 3 includes a fifth and sixth PMOS transistors being connected in series between the first node N1 and the ground voltage VSS, each having a gate connected to the ground voltage VSS; a seventh and eighth PMOS transistors PM7 and PM8 being connected in series between the first node N1 and a sensing node NS, each having a gate connected to the ground voltage VSS; and a third NMOS transistor NM3 having a gate connected to the ground voltage VSS and a drain connected to the sensing node NS so as to sense a level of the back bias voltage VBB applied to a source thereof.

The back bias voltage level sensor 4 includes a second and a third inverter INV2 and INV3 for sequentially inverting a level of the sensing node NS; a first NAND gate ND1 having a first input terminal to which an output signal from the third inverter INV3 is applied, and a second input terminal to which the switch control signal DETSW is applied; and a fourth inverter INV4 for inverting the output signal from the NAND gate ND1 and outputting a sensing signal DETA.

The switching controlling unit 5 includes a first NOR gate NOR1 having a first input terminal to which the sensing signal DETA is applied, and a second input terminal to which the oscillating signal OSC is applied; and a fifth inverter INV5 for inverting the output signal from the first NOR gate NOR1 and outputting the switch control signal DETSW.

The operation of the back bias voltage level sensing circuit of the conventional art constructed as described above will now be explained.

A gate voltage of the first NMOS transistor NM1 is constantly maintained by the general constant voltage generating circuit having the first PMOS transistor PM1 and the first NMOS transistor NM1, regardless of a variation of the power supply voltage VCC.

As to the constant current generating circuit having the second PMOS transistor PM2 and the second NMOS transistor NM2, since the first and second NMOS transistors NM1 and NM2 have the commonly connected gate, having the same voltage, the voltage difference VGS between the gate and the source of the second NMOS transistor NM2 is constantly maintained. Accordingly, a constant current is generated regardless of a variation in the power supply voltage VCC. Also, since the voltage difference VGS between the gate and the source of the second PMOS transistor PM2 is constantly maintained, a voltage difference between the power supply voltage VCC and the gate voltage of the second PMOS transistor PM2, so that a constant current ICON is generated through the third PMOS transistor PM3.

The constant current ICON of the constant current generation unit 1 is transferred or disconnected in a predetermined period by the switch 2 which is controlled by the switch control signal DETSW.

The constant current ICON transferred by the switch 2 is distributed to a first distribution current ID1 and a second distribution current 1D2 by the current distribution unit 3. The distribution rate is determined by the length and the width of each channel of the fifth, sixth, seventh and eighth PMOS transistors.

A reference level VREF of the back bias voltage VBB to be sensed is determined by the voltage difference VGS between the gate and the source of the third NMOS transistor NM3 at the time when the second distribution current ID2, distributed over the constant current ICON through the third NMOS transistor NM3, flows thereto, and at this time, the voltage level of the sensing node NS is set by a logic threshold voltage VTH of the second inverter INV2.

When the switch 2 is turned on, if the level of an applied back bias voltage VBB is higher than the reference level VREF, the level of the sensing node NS becomes higher than the threshold voltage VTH of the second inverter INV2, so that the output signal from the second inverter INV2 becomes a low level and the sensing signal DETA is changed to a high level. Accordingly, the switch control signal DETSW becomes a high level regardless of the oscillating signal OSC to keep the switch 2 being turned on. At this time, the back bias voltage pumping circuit (not shown) is driven, rendering the back bias voltage level to be gradually lowered down.

Reversely, when the level of an applied back bias voltage is lower than the reference level VREF, the level of the sensing node NS becomes lower than the threshold voltage VTH of the second inverter INV2 and the sensing signal DETA becomes a low level so as to stop the pumping operation of the back bias voltage pumping circuit (not shown), and the switch control signal DETSW become a low level to turn off the switch 2.

In this respect, whether or not the switch 2 is turned on or turned off is determined by the oscillating signal OSC. Thus, when the switch control signal DETSW becomes a low level as the oscillating signal OSC becomes a low level as shown in FIG. 2A and FIG. 2B, the switch 2 is turned off to disconnect the constant current ICON and the level of the sensing node NS is the same as that of the back bias voltage VBB as shown in FIG. 2E.

Meanwhile, when the switch control signal DETSW is changed to a high level, and thus, the switch 2 is turned on, if the level of the back bias voltage VBB is lower than the reference level VREF, the level of the sensing node NS becomes lower than that of the threshold voltage VTH of the second inverter INV2. Then, the output signal from the second inverter INV2 becomes a high level and the sensing signal DETA becomes a low level, so that the back bias voltage pumping circuit (not shown) won't perform pumping operation.

However, though the strength of the second distribution current ID2 generated for sensing the level of the back bias voltage and distributed over the constant current ICON by the current distribution unit 3 is merely a few micro ampere $\mu$A, a few mili ampere mA of a switching peak current, that is generated when the third PMOS transistor PM3 of the switch 2 is turned on or turned off, flows. Thus, when the switch 2 is turned on, as shown in FIG. 2C, since the level of the sensing node NS is heightened by inflow of the switching peak current, even though the back bias voltage level is lower than the reference level VREF, as shown in FIG. 2D, the sensing signal DETA becomes a high level so as to drive the back bias voltage pumping circuit until the heightened level of the sensing node NS is dropped down to be lower than the threshold voltage VTH of the second inverter INV2.

Accordingly, the back bias voltage level is lowered down, and the lowered back bias voltage level is applied to a substrate of a semiconductor memory device, rendering the threshold voltage of a MOS transistor to be increased, which causes problems in that the operational speed of the semiconductor memory device is delayed and the back bias voltage pumping circuit is malfunctioned, resulting in increasing a current consumption.

SUMMARY OF THE INVENTION

Therefore, an object of the present invention is to provide a back bias voltage level sensing circuit in which a switching ON/OFF mode is changed according to an operational mode of a semiconductor memory device to thereby prevent a malfunction caused due to a switching peak current generated when the switch is turned on and turned off.

To achieve these and other advantages and in accordance with the purposed of the present invention, as embodied and broadly described herein, there is provided a back bias voltage level sensing circuit including: a constant current generation unit for generating a constant current regardless of a variation in a power supply voltage; a switch for transferring or disconnecting the constant current generated from the constant current generation unit under the control of a switch control signal; a current distribution unit for distributing the constant current transferred by the switch by using a current mirror under the control of a first control signal; a switching current removal unit for flowing the switching current generated as the switch is turned on and turned off to the ground according to a second control signal; a back bias voltage level sensing unit for sensing a level of a back bias voltage and outputting a sensing signal according to the current distributed by the current distribution unit; and a switching controlling unit for receiving an oscillating signal and the sensing signal from the back bias voltage level sensing unit and outputting a switch control signal for turning on and turning off the switch in a predetermined period, a first control signal for controlling the current distribution unit, and a second control signal for controlling the switching current removal unit.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings.

Figure 1:
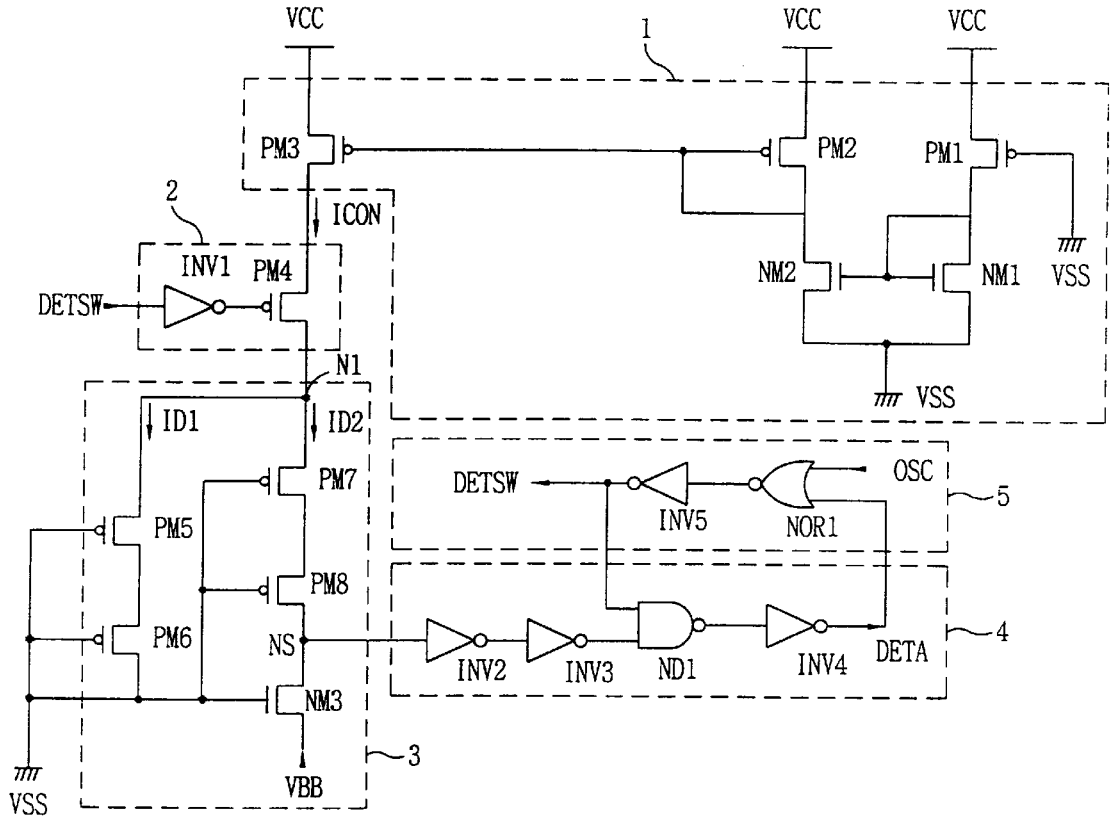
FIG. 1 BACKGROUND ART
FIG. 1 is a circuit diagram of a back bias voltage level sensing circuit in accordance with a conventional art.
Figures 2A, 2B, 2C, 2D, 2E:
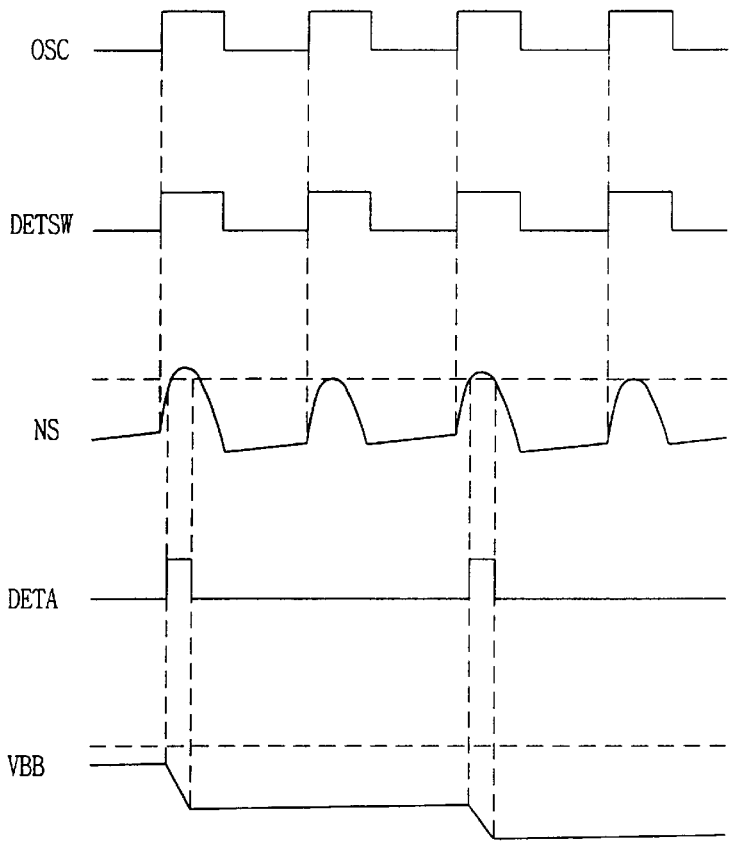
FIG. 2A BACKGROUND ART
FIG. 2B BACKGROUND ART
FIG. 2C BACKGROUND ART
FIG. 2D BACKGROUND ART
FIG. 2E BACKGROUND ART
FIGS. 2A through 2E show operational timing of the back bias voltage level sensing circuit of FIG. 1.
Figure 3:
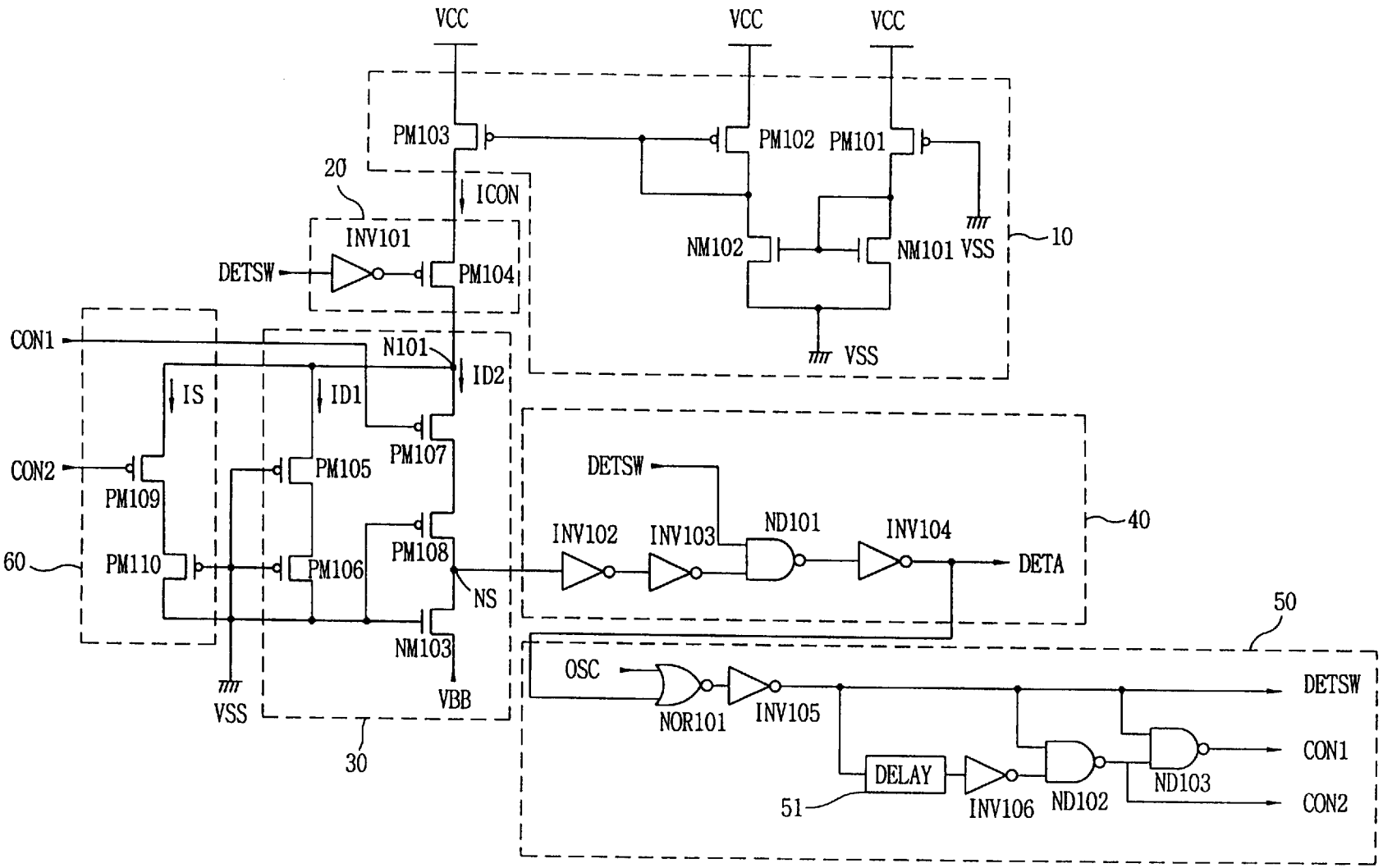
FIG. 3 is circuit diagram of a back bias voltage level sensing circuit in accordance with the present invention.

FIG. 3 is a circuit diagram of a back bias voltage level sensing circuit in accordance with the present invention. As shown in this drawing, the back bias voltage level sensing circuit includes a constant current generation unit 10 for generating a constant current ICON regardless of a variation in a power supply voltage VCC; a switch 20 for transferring or disconnecting the constant current ICON generated from the constant current generation unit 10 under the control of a switch control signal DETSW; a current distribution unit 30 for distributing the constant current transferred by the switch 20 by using a current mirror under the control of a first control signal CON1; a switching current removal unit 60 for flowing the switching current generated when the switch 20 is turned on and turned off to the ground according to a second control signal CON2; a back bias voltage level sensing unit 40 for sensing a level of a back bias voltage VBB and outputting an output signal DETA according to the current distributed by the current distribution unit 30; and a switching controlling unit 50 for receiving an oscillating signal OSC and the output signal DETA from the back bias voltage level sensing unit 40 and outputting a switch control signal DETSW for turning on and turning off the switch in a predetermined period, a first control signal CON1 for controlling the current distribution unit 30, and a second control signal CON2 for controlling the switching current removal unit 60.

The constant current generation unit 10 includes a first PMOS transistor PM101 being connected in series between the power voltage supply VCC and the ground voltage VSS, having a gate connected to the ground voltage VSS; a first NMOS transistor NM101 having a gate and a drain commonly connected; a second PMOS transistor PM102 connected in series between the power supply voltage VCC and the ground voltage VSS, having a gate and a drain commonly connected; a second NMOS transistor NM102 having a gate connected to the gate of the first NMOS transistor NM101; a third PMOS transistor PM103 having a source to which the power supply voltage VCC is applied, a gate connected to the gate of the second PMOS transistor PM102 and a drain to which the constant current ICON flows.

The switch 20 includes a fourth PMOS transistor PM104 having a gate to which a switch control signal DETSW is applied as inverted by the first inverter INV101, a source to which the constant current ICON of the constant current generation unit 10 is applied, and a drain connected to the first node N101.

The current distribution unit 30 includes a fifth and a sixth PMOS transistors PM105 and PM106 being connected in series between the first node N101 and the ground voltage VSS, each having a gate connected to the ground voltage VSS; a seventh PMOS transistor PM107 being connected in series between the first node N101 and the sensing node NS, having a gate to which a first control signal CON1 is applied; an eighth PMOS transistor PM108 having a gate connected to the ground voltage VSS; and a third NMOS transistor NM103 having a gate connected to the ground voltage VSS, a drain connected to the sensing node NS so as to sense the level of the back bias voltage VBB applied to a source thereof.

The back bias voltage level sensing unit 40 includes a second and a third inverters INV102 and INV103 for sequentially inverting a level of the sensing node NS; a first NAND gate ND101 for applying the switch control signal DETSW to a second input terminal thereof; and a fourth inverter INV104 for inverting the output signal from the NAND gate ND101 and outputting the sensing signal DETA.

The switching controlling unit 50 includes a NOR gate NOR101 to which a sensing signal DETA and the oscillating signal OSC are applied; a fifth inverter INV105 for inverting the output signal from the NOR gate NOR101 and outputting a switch control signal DETSW; a delay 51 for delaying the output signal DETSW for a predetermined time; a sixth inverter INV106 for inverting the output signal from the delay 51; a second NAND gate ND102 for receiving an output signal from the sixth inverter INV106 at its first input terminal and an output signal from the fifth inverter INV105 at its second input terminal and outputting a second control signal CON2; and a third NAND gate ND103 for receiving the output signal from the second NAND gate ND102 at its first input terminal and the switch control signal DETSW at its second input terminal, and outputting a first control signal CON1.

The switching current removal unit 60 includes a ninth PMOS transistor PM109 connected in series between the first node N101 and the ground voltage VSS, having a gate to which the second control signal CON2 is applied; and a tenth PMOS transistor PM110 having a gate connected to the ground voltage VSS.

The operation of the back bias voltage level sensing unit constructed as described above will now be explained with reference to FIGS. 4A through 4G.

First, the gate voltage of the first NMOS transistor NM101 is constantly maintained by the general constant voltage generation circuit consisting of the first PMOS transistor PM101 and the first NMOS transistor NM101 regardless of a variation in the power supply voltage.

As to the constant current generation circuit consisting of the second PMOS transistor PM102 and the second NMOS transistor NM102, since the gates of the first and second NMOS transistors NM101 and NM102 are commonly connected, having the same voltage level, a voltage difference VGS between the gate and the source of the second NMOS transistor NM102 is constantly maintained, so that a constant current is generated regardless of the variation in the power supply voltage VCC. And, since the voltage difference VGS between the gate and the source of the second PMOS transistor PM102 is also constantly maintained, a voltage difference between the power supply voltage VCC and the gate voltage of the second PMOS transistor PM102 is constantly maintained, thereby generating the constant current ICON through the third PMOS transistor PM103.

Figures 4A, 4B, 4C, 4D, 4E, 4F, 4G:
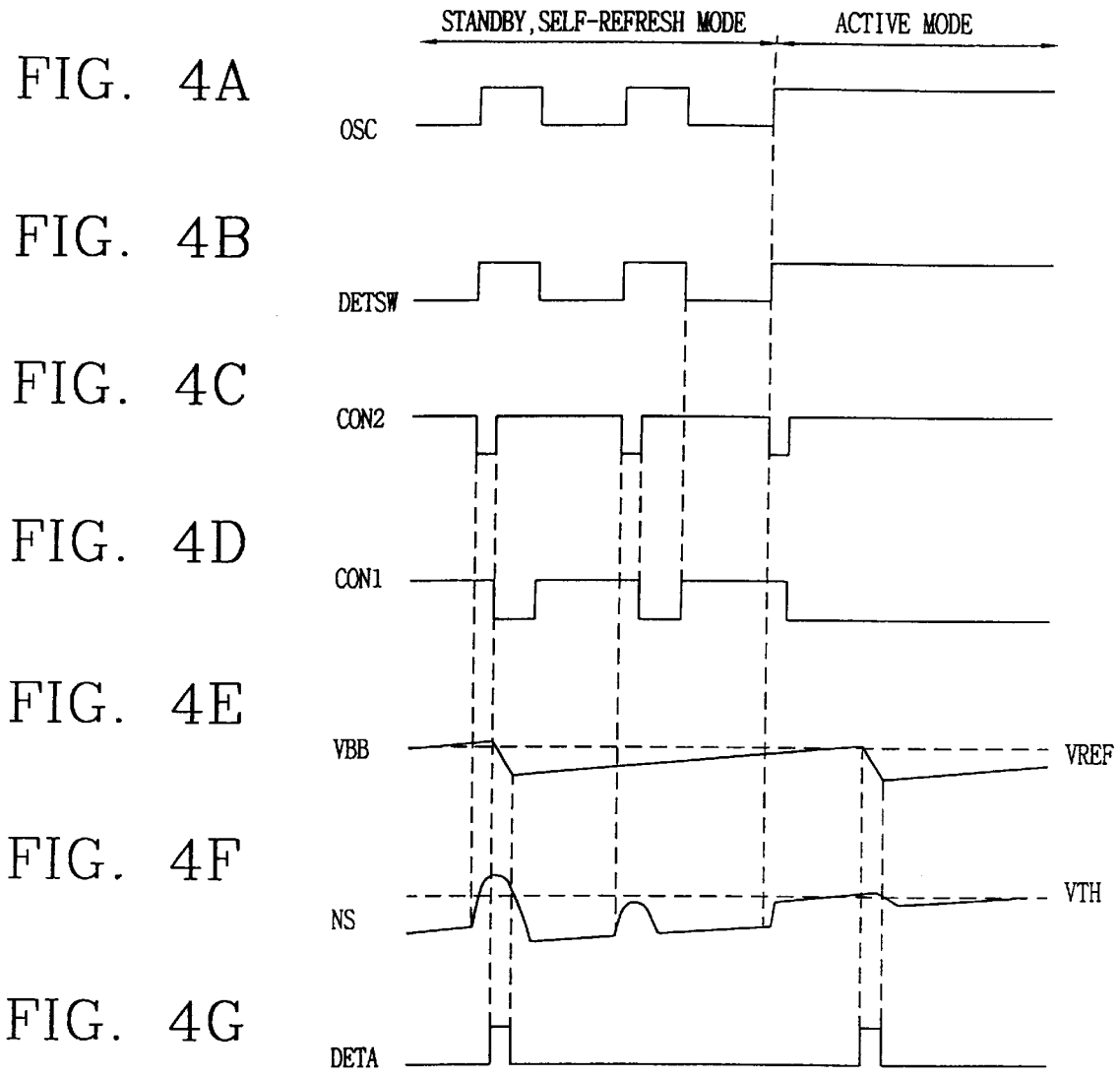
FIGS. 4A through 4G show operational timing of the back bias voltage level sensing circuit of FIG. 3.

The constant current ICON of the constant current generation unit 10 is transferred or disconnected by the switch 20 that is controlled by the switch control signal DETSW according to a predetermined period. At this time, in an active operation mode, as shown in FIG. 4A, the oscillating signal OSC is maintained at a high level so as to fix the switch control signal DETSW at a high level as shown in FIG. 4B. By doing that, the switch 20 is kept turning on, to thereby correspond to the variation of the back bias voltage level.

In addition, in other operation mode, the switch 20 is controlled by the oscillating signal having a predetermined period so as to sense the back bias voltage level, thereby reducing a current consumption.

At an initial state, since the back bias voltage level is lower than the reference level VREF as shown in FIG. 4E, the sensing signal DETA has a low level as shown in FIG. 4G.

Meanwhile, in a standby mode or a self-refresh mode, the sensing signal DETA is changed to a high level by the oscillating signal OSC having a predetermined period, the second control signal CON2 as shown in FIG. 4C, that is, a negative pulse signal having a pulse width as much as a delay rate TD1 of the delay 51 of the switching controlling unit 50 is generated. Accordingly, the switching current generated when the fourth PMOS transistor PM104 of the switch 20 is turned on is flown to the ground by the ninth and the tenth PMOS transistors PM109 and PM110 of the switching current removal unit 60 and by the fifth and the sixth PMOS transistors PM105 and PM106 of the current distribution unit 30, so as to be removed.

Subsequently, when the second control signal CON2 is changed to a high level so as to turn off the ninth PMOS transistor PM109 of the switch current removal unit 60, the first control signal CON1 as shown in FIG. 4D is changed to a low level to turn on the seventh PMOS transistor PM107 of the current distribution unit 30, so that the constant current ICON is distributed by a current mirror consisting of the fifth, the sixth, the seventh and the eighth PMOS transistors PM105, PM106, PM107 and PM108, thereby sensing the back bias voltage level.

Reversely, when the switch control signal DETSW is changed to a low level, the seventh and the ninth PMOS transistors PM107 and PM108 are turned off, so that the switching current is flown to the ground through the fifth and the sixth PMOS transistors PM105 and PM106 so as to be removed.

Meanwhile, in the operation mode for sensing the back bias voltage level, the constant current ICON transferred by the switch 20 is distributed to a first distribution current ID1 and a second distribution current ID2 by the current distribution unit 30. In this respect, the distribution rate is determined by the length and the width of each channel of the fifth, the sixth, the seventh, and the eighth PMOS transistors PM105, PM106, PM107 and PM108.

The reference level VREF of the back bias voltage VBB to be sensed is determined by the voltage difference VGS between the gate and the source of the third NMOS transistor NM3 at the time when the second distribution current ID2, which was distributed over the constant current ICON, flows through the third NMOS transistor NM103, for which a voltage level of the sensing node NS is set by the logic threshold voltage VTH of the second inverter INV102.

When the switch 20 is turned on, if the level of an applied back bias voltage VBB is higher than the reference level VREF, the level of the sensing node NS as shown in FIG. 4F becomes higher than the threshold voltage VTH of the second inverter INV2. Accordingly, the output signal of the second inverter INV102 becomes a low level and the sensing signal DETA as shown in FIG. 4G is changed to a high level, so that the switch control signal DETSW becomes a high level regardless of the oscillating signal OSC, rendering the switch 20 to keep turning on. At this time, the back bias voltage pumping circuit (not shown) is driven to lower down the back bias voltage level.

Reversely, if the level of an applied back bias voltage VBB is lower than the reference level VREF, the level of the sensing node NS becomes lower than the threshold voltage VTH of the second inverter INV2, so that the sensing signal DETA becomes a low level to thereby stop the pumping operation of the back bias voltage pumping circuit, and the switch control signal DETSW becomes a low level to turn off the switch 2. At this time, whether the switch 20 is turned on or turned off is determined by the oscillating signal OSC, and if the oscillating signal OSC becomes a low level, and thus, the switch control signal DETSW becomes a low level, the switch 20 is turned off to disconnect the constant current ICON, and the level of the sensing node NS becomes the same as that of the back bias voltage VBB.

Meanwhile, when the switch control signal DETSW is changed to a high level and the switch 20 is turned on, if the level of the back bias voltage VBB is lower than the reference level VREF, the level of the sensing node NS becomes lower than the threshold voltage VTH of the second inverter INV102. Accordingly, the output signal of the second inverter INV102 becomes a high level and the sensing signal DETA becomes a low level, so that the back bias voltage pumping circuit does not perform a pumping operation.

As so far described, according to the back bias voltage level sensing circuit of the present invention, a path is generated for flowing the switching current, which is generated when the fourth PMOS transistor PM104 of the switch 20 is turned on or turned off, to the ground, so that the switching current doesn't affect the back bias voltage level sensing unit, which advantageously prevents a delay in the operation of the semiconductor memory device and a malfunction of the back bias voltage pumping circuit, having an effectiveness of reduction in current consumption.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the meets and bounds of the claims, or equivalence of such meets and bounds are therefore intended to be embraced by the appended claims.

What is claimed is:

1. A back bias voltage level sensing circuit comprising:

a constant current generation unit for generating a constant current regardless of a variation in a power supply voltage;

a switch for transferring or disconnecting the constant current generated from the constant current generation unit under the control of a switch control signal;

a current distribution unit for distributing the constant current transferred by the switch by using a current mirror under the control of a first control signal;

a switching current removal unit for flowing the switching current generated when the switch is turned on and turned off to the ground according to a second control signal;

a back bias voltage level sensing unit for sensing a level of a back bias voltage and outputting an output signal according to the current distributed by the current distribution unit; and a switching controlling unit for receiving an oscillating signal and the output signal from the back bias voltage level sensing unit and outputting a switch control signal for turning on and turning off the switch in a predetermined period, a first control signal for controlling the current distribution unit, and a second control signal for controlling the switching current removal unit.

2. The circuit according to claim 1, wherein the current distribution unit includes:

a fifth and a sixth PMOS transistors being connected in series between the first node and the ground voltage, each having a gate connected to the ground voltage;

a seventh PMOS transistor being connected in series between the first node and the sensing node, having a gate to which a first control signal is applied;

an eighth PMOS transistor having a gate connected to the ground voltage; and a third NMOS transistor having a gate connected to the ground voltage VSS, a drain connected to the sensing node so as to sense the level of the back bias voltage applied to a source thereof.

3. The circuit according to claim 1, wherein the switching controlling unit includes:

a NOR gate to which a sensing signal and the oscillating signal are applied;

a fifth inverter for inverting the output signal from the NOR gate and outputting a switch control signal;

a delay for delaying the output signal for a predetermined time;

a sixth inverter for inverting the output signal from the delay;

a second NAND gate for receiving an output signal from the sixth inverter at its first input terminal and output signal from the fifth inverter at its second input terminal and outputting a second control signal; and a third NAND gate for receiving the output signal from the second NAND gate at its first input terminal and the switch control signal at its second input terminal, and outputting a first control signal.

4. The circuit according to claim 1, wherein the switching current removal unit includes:

a ninth PMOS transistor connected in series between the first node and the ground voltage, having a gate to which the second control signal is applied; and a tenth PMOS transistor having a gate connected to the ground voltage.

5. The circuit according to claim 3, wherein the first control signal is changed to a low level at the time when the second control signal is changed to a high level.

* * * * *